United States Patent [19]

Wade et al.

[11] Patent Number: 4,808,037

[45] Date of Patent: Feb. 28, 1989

[54] METHOD AND APPARATUS FOR REMOVAL OF SUBMERGED OFFSHORE OBJECTS

[75] Inventors: Franklin C. Wade, 6045 General Meyer Ave., New Orleans, La. 70114; Richard A. Anderson, Harvey, La.; Richard H. Barron, 127 Antiqua Dr., Lafayette, La. 70503

[73] Assignees: Franklin C. Wade, New Orleans; Richard H. Barron, Lafayette, both of La.

[21] Appl. No.: 83,639

[22] Filed: Aug. 7, 1987

Related U.S. Application Data

[63] Continuation-in-part of Ser. No. 18,692, Feb. 25, 1987, abandoned, which is a continuation-in-part of Ser. No. 924,266, Oct. 29, 1986, abandoned.

[51] Int. Cl.[4] ..... E02D 9/04

[52] U.S. Cl. ..... 405/226; 29/426.4; 83/16; 166/55; 166/55.2; 405/227; 405/232

[58] Field of Search ..... 405/195, 224, 226, 227, 405/228, 231, 232; 29/426.4; 83/15, 16, 22; 166/55, 55.1, 55.2, 55.6, 55.7, 55.8, 297, 298, 302; 225/2, 96, 96.5

[56] References Cited

U.S. PATENT DOCUMENTS

| | | | |
|---|---|---|---|
| 2,873,676 | 2/1959 | Caldwell | 166/55.2 X |
| 3,062,294 | 11/1962 | Huitt et al. | 166/55.2 X |
| 3,101,051 | 8/1963 | Gilbert | 166/55.2 X |
| 3,336,759 | 8/1967 | Copper | 407/227 |
| 3,352,119 | 11/1967 | Manning | 405/227 X |
| 3,419,089 | 12/1968 | Venghiattis | 166/55.2 X |
| 3,526,162 | 9/1970 | Willcox | 83/16 |
| 3,555,831 | 1/1971 | Pogonowski | 405/227 |
| 4,043,019 | 8/1977 | Schroder | 29/426.4 X |
| 4,322,182 | 3/1982 | Ostgaard | 405/227 |
| 4,367,056 | 1/1983 | Seneviratne | 405/228 |
| 4,598,769 | 7/1986 | Robertson | 166/55 |
| 4,619,556 | 10/1986 | Parra | 405/195 |

*Primary Examiner*—David H. Corbin

*Attorney, Agent, or Firm*—Lalos & Keegan

[57] ABSTRACT

A method for removal of large metal objects such as offshore platforms that may be embedded in or substantially immobile and lying on the seabed. The environment should be dislodged from at least a portion of the supporting pile embedded below the mud line. A liquified gas is injected into the environment in contact with the pile to embrittle the pile. Upon embrittlement, the pile is fragmented. Thereafter, the pile may be removed from the seabed.

A cannister for use in the above method has a body shaped to conform to the pile or object to be fragmented and contains liquified gas to be sprayed from nozzles by a pressurized gas to chill the object to be fragmented upon embrittlement. A support is positioned on the body for raising and lowering the cannister within the pile.

A fragmentation tool for insertion into the pile or other object to be removed from embedment in the sea and having a plurality of anvils housed in open ended elongated tubes, a propulsion means generating gas pressure, a frangible connection that ruptures when sufficient pressure is generated to propel the anvils to strike the embrittled area and cause fragmentation.

An apparatus for applying tension to the pile before fragmentation consists of one or more hydraulic rams connected between the pile and the concentric jacket.

110 Claims, 5 Drawing Sheets

S
W
P
W.L.
58
J
TO
POWER SOURCE
56
86
60
39
M
BOTTOM
F
72
44
50
62
82
66
54
80
64
52
82
84
EMBRITTLED
SECTION
R
70
74
46
78
76
68
48
66

70
76
78
92
90
48
76
90
92
94
92
76
48
94
78
76
88
48

J
P
W.L.
S
58
W
TO
POWER SOURCE
56
86
60
86
39A
M
BOTTOM
F
82
64
82
46
84
EMBRITTLED
SECTION
R
88
66
46
39A
74
46
66

METHOD AND APPARATUS FOR REMOVAL OF SUBMERGED OFFSHORE OBJECTS

The present invention is a continuation-in-part to application Ser. No. 018,692 filed on Feb. 25, 1987, now abandoned, which is a continuation-in-part to application Ser. No. 924,266 filed on oct. 29, 1986, now abandoned.

BACKGROUND OF THE INVENTION

Offshore activity is performed on a massive scale in the quest for petroleum and the production of petroleum from discovered pools. It is a common occurrence that structures built in the past to find or develop petroleum are no longer to be used, either because the petroleum pool has become depleted, or was found not to be economically feasible. These structures, such as offshore platforms, drilling rigs, conductors or the like, can become a navigational hazard and must be removed. Also sunken ships, boats, pipelines and other metal objects that have been part of the offshore activity or related or even unrelated activities may become lodged on the ocean bottom and are sought to be removed for a variety of reasons.

In particular, offshore platforms and drilling rigs that have been constructed and then abandoned must be removed to avoid the navigational hazard that would be obvious. Such removal has typically been not too complex because, in one method, it simply involved the use of explosives that may be positioned around the support piling embedded perhaps hundreds of feet into the ocean floor. In some instances, the explosives are lowered within the cylindrical pile and exploded at a level below the mudline so that no remaining portion of the pile is permitted to protrude from the mudline. In such instance, however, the explosion distorts the pile to such an extent that it is not possible to lift the pile out from within its surrounding jacket that extends from the platform down to but not below the mudline. Even with such a disadvantage, explosive devices have continued to be utilized in the past and have admittedly been successful in the total removal of the piling down to at least the required 15 feet below the mudline. This method, even though in widespread use, is now no longer permitted by the United States Government due to the environmental impact caused by the explosion.

It has been found that explosive devices detonated no matter how far below sea level cause great damage to the marine life, not only due to the explosive force which has the effect of sending shock waves for many miles, but also due to the chemical remnants of the explosive that remain in the sea to create havoc with the marine life. Additionally, the noise emanating from the blast produces sound waves that are harmful to the living creatures of the sea.

Thus, though it is still essential that these structures be removed, the use of explosives is illegal and no longer available in U.S. territorial waters. It is anticipated that other governments will appreciate the significant hazard posed by explosives to marine life and require the removal of such undersea structures in areas within their own territorial waters to be limited to non-explosive techniques and the present invention in particular.

OBJECT OF THE INVENTION

It is accordingly one of the objects of the present invention to provide means and method for achieving the goal of removing offshore structures, which are either embedded or otherwise lying on the seabed floor, without the use of explosives so as to avoid the detrimental effects of the explosive shock waves, the sound waves and the deleterious chemical explosion by-products on the marine life in the explosion environment.

It is a further object of the present invention to utilize non-explosive techniques for the cryogenic fragmentation of piling that support an offshore platform, drilling rig or the like and permit its safe and easy removal.

It is yet another object of the present invention to provide the method and means for lowering a cannister for dispensing a liquified gas into a pile that has been previously evacuated by airlift to dislodge the mud and water within the piling, and then inject the liquified gas from the cannister to chill the pile to a temperature below its embrittlement temperature at which time a force applied to the pile will fragment the pile so that it may be removed easily through the surrounding jacket.

Still another object of the present invention is the provision of a unique cannister that is able to be formed into a size shaped so that it will fit into an environment around the object to be cryogenically fragmented and release the liquified gas contained therein to bring about the embrittlement.

Another object of the present invention is the injection of liquified gas into a previously evacuated environment of an object portion to be fragmented in such a substantial amount that the object portion will be embrittled for subsequent fragmentation by application of a suitable force.

A further object of the present invention is to fragment the cryogenically embrittled pile in a safe and effective manner that enables the pile to be easily removed from an embedded position beneath the floor of the sea.

Another object of this invention is the provision of a tool for insertion into the pile adjacent the area of embrittlement and having a plurality of anvils that are directed into striking contact with the embrittled pile at such force so as to fragment the embrittled area and free the pile from the lower and more deeply embedded remaining portion of the pile.

Another object of the present invention is to provide for a means and method for fragmenting a submerged and embedded pile including cryogenically embrittling said pile beneath the mud line, providing tension to said pile and fragmenting said pile for ease of removal of the pile from the seabed.

SUMMARY

A method for removal of large metal objects that may be embedded in or substantially immobile and lying on the seabed. The method may be applied to platforms, drilling rigs, conductors, ships, boats, pipe or other metal objects found offshore. At least a portion of the environment should be dislodged from at least a portion of the object such as a pile embedded below the mudline. A liquified gas is injected into the environment in a sufficient amount to cryogenically embrittle the pile or object upon sufficient contact with the pile or object. Upon embrittlement the pile or object can be fragmented by application of an applied force. Thereafter the pile or object may be removed from the seabed.

A cannister for use in removing large objects embedded or lying immobile on the seabed floor. The cannister has a body shaped to conform to the object to be fragmented and contains liquified gas to be used to chill the object to be fragmented upon embrittlement. Nozzles are positioned on the cannister to discharge the liquified gas in the cannister and inlet means is positioned on the body of the cannister to permit a pressurizing gas to be admitted to the cannister to force out the liquified gas. A support is positioned on the body for raising and lowering the cannister within the object such as within the diameter of a pile. When the pressurizing gas is activated to force the liquified gas out the nozzles of the cannister into contact with the metal object to chill the object below its embrittlement temperature, fragmentation is produced by application of an applied force permitting subsequent raising and removal of the object or pile.

A fragmentation tool for insertion into the pile or other object to be removed from embedment in the sea and being provided with a plurality of anvils each housed within an open ended elongated tube, a propulsion means generating gas pressure is connected to the junction of the tubes, a frangible connection ruptures when sufficient pressure is generated to propel the anvils to strike the embrittled area and cause fragmentation.

An apparatus for applying tension to the pile before fragmention consists of one or more hydraulic rams connected between the pile and the concentric jacket. dr

THE DRAWINGS

Figure 5:
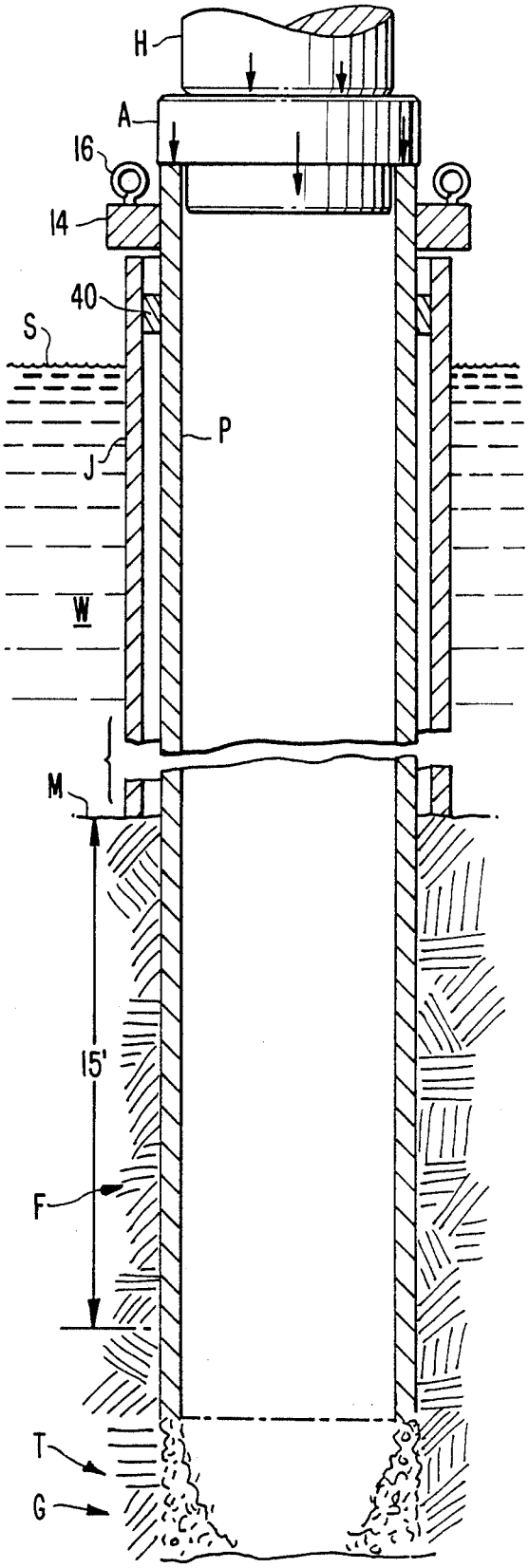

FIG. 5 a cross-sectional view partly broken away, illustrating the application of a force from a hammer pile driver to cause the fragmentation shown in the embrittled portion of the pile.

Figure 6:
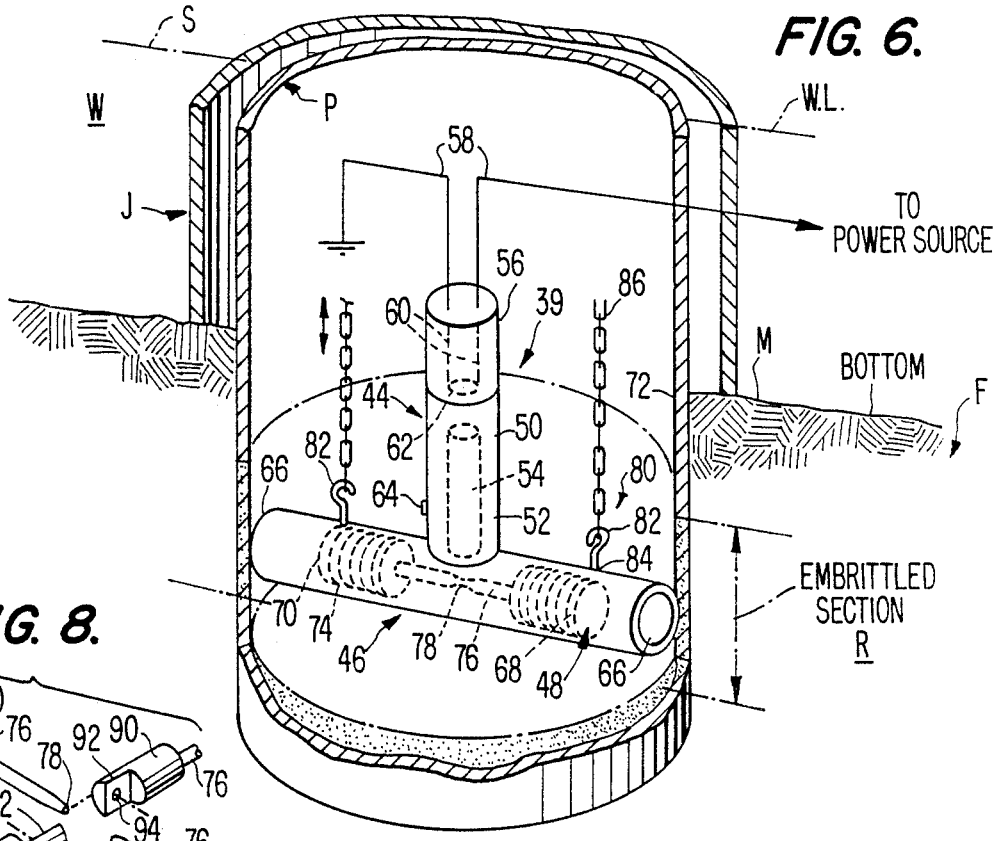

FIG. 6 is a perspective view, partly broken away illustrating the two barrel fragmentation tool with the frangible rod.

Figure 7:
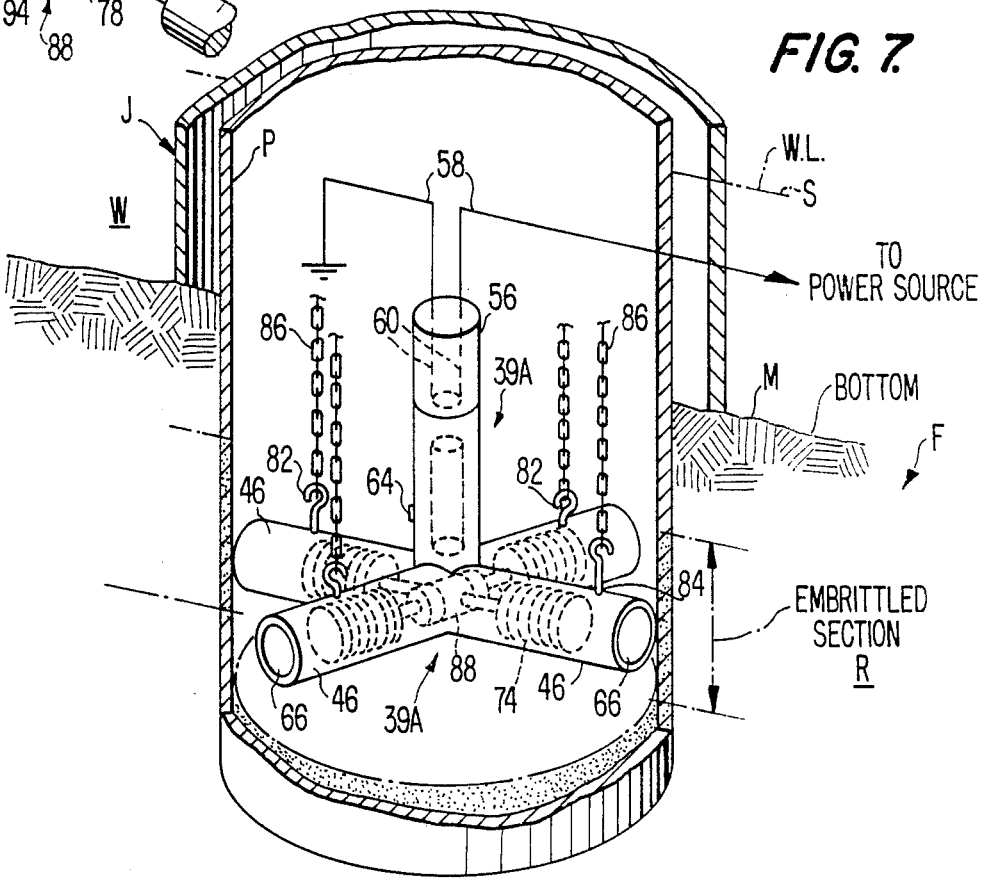

FIG. 7 identical to FIG. 6 except a four barrel cruciform arrangement modification is illustrated along with a separable connected in phantom lines.

Figure 8:
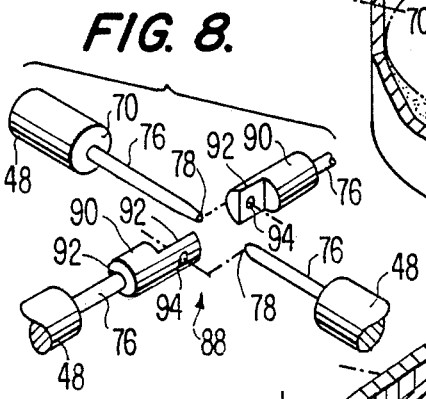

FIG. 8 is an exploded view of the separable connector of FIG. 7 and the severed frangible rod.

Figure 9:
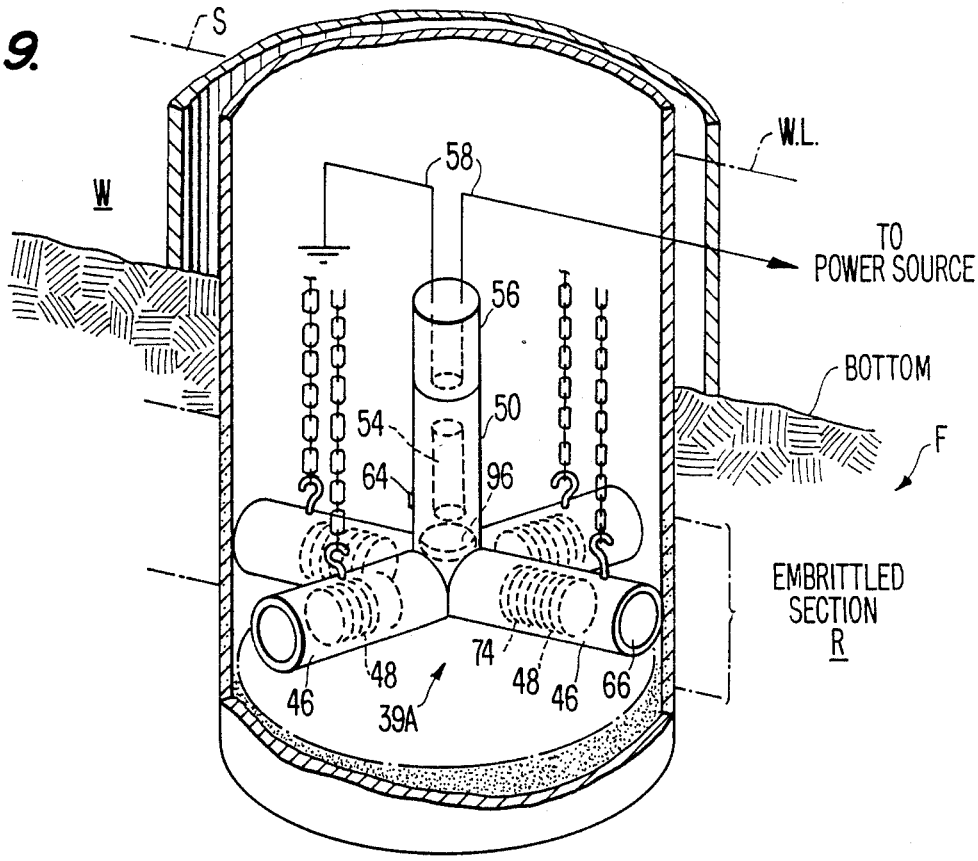

FIG. 9 is identical to FIG. 6 but illustrating another modification in the form of the frangible disc separating the propulsion area from the junction of the barrels.

Figure 10:
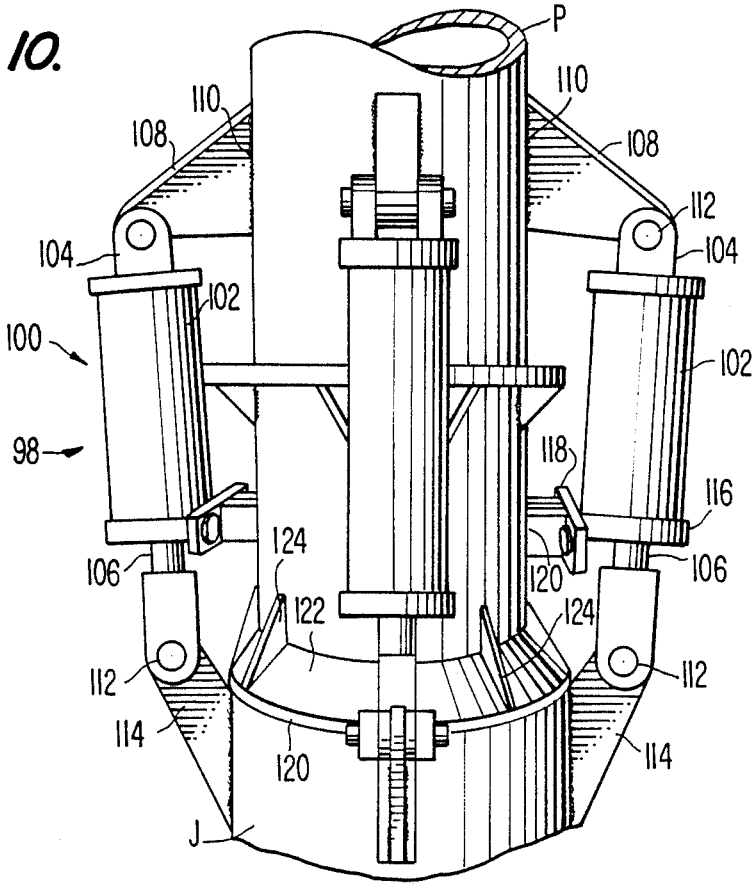

FIG. 10 is a perspective view, partly broken away illustrating the tensioning apparatus for providing tension to the pile prior to fragmenting.

Figure 11:
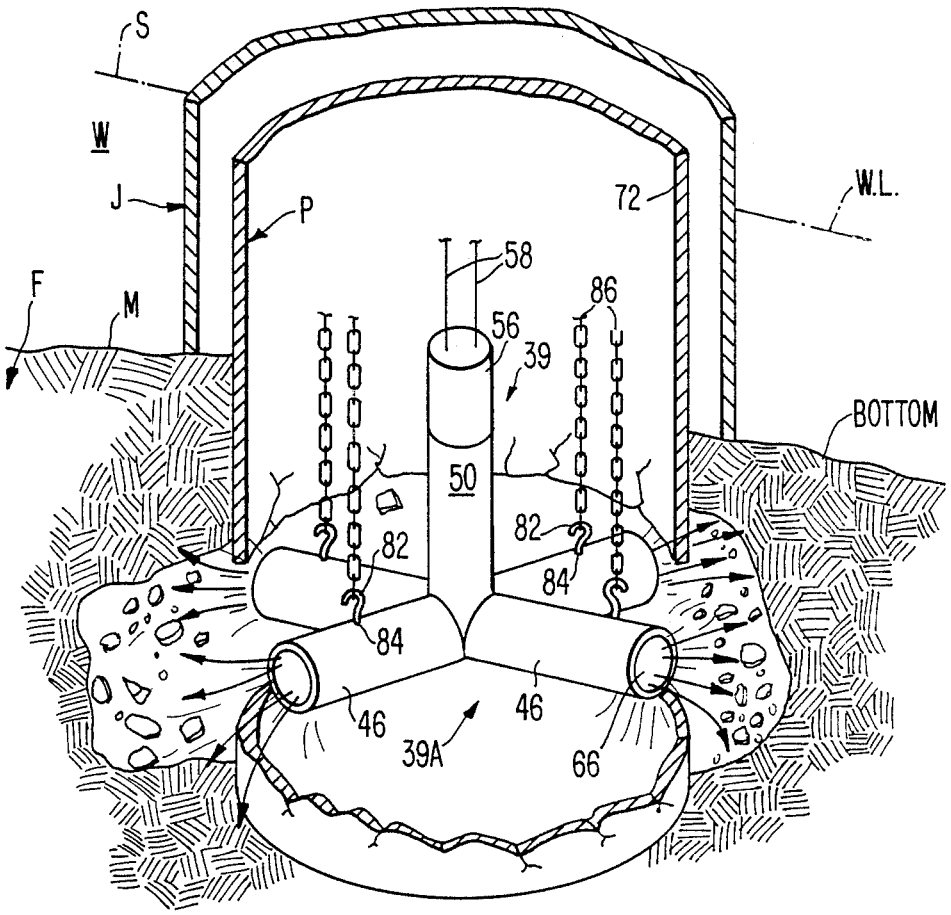

FIG. 11 is a perspective view of the invention shown in FIG. 7 after the pile has been fragmented.

DESCRIPTION OF THE PREFERRED EMBODIMENT

This invention has a broad scope in that it is capable of being applied to various objects that may be embedded in or lying on the sea floor. Such objects can include offshore platforms, drilling rigs, conductors, ships, boats, pipe, or other heavy metal objects that are difficult or perhaps impossible to retrieve because of their weight or immobile position. The principal description of the invention will be directed to the removal of the supporting members, i.e., piles, for an offshore platform though any similar or related structure could be also removed.

Figure 1:
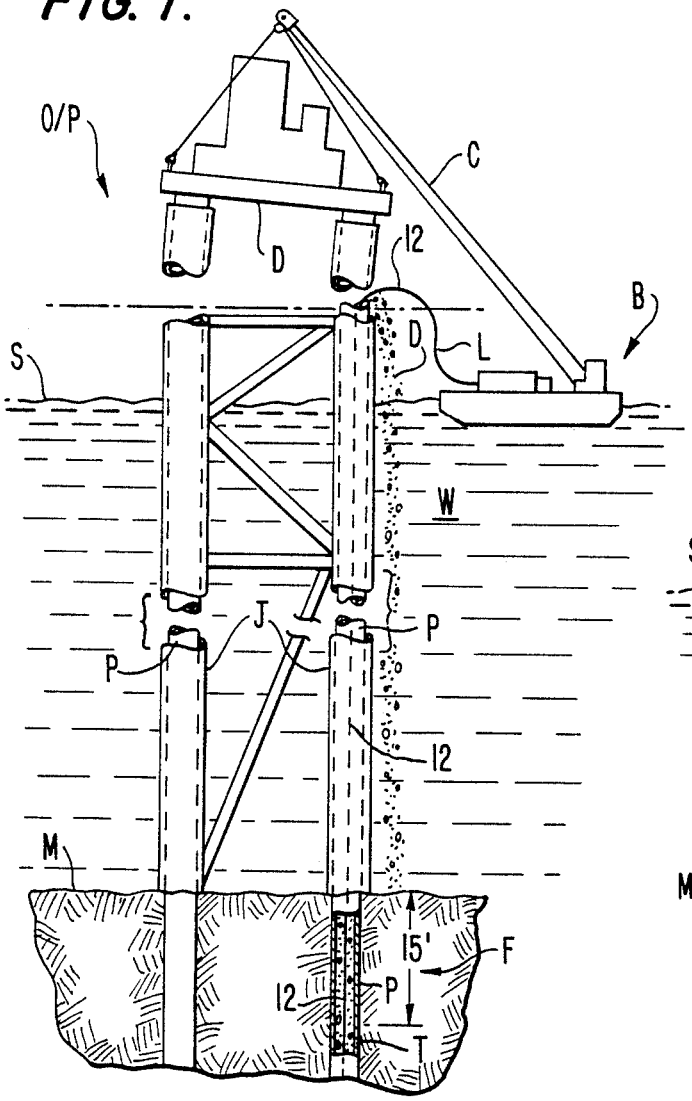
FIG. 1 is a schematic side view drawing, partly broken away, illustrating a platform supported by conventional piling embedded into the sea floor and being tended to by a surface barge providing an airlift within the piling to evacuate mud and water as shown. The deck of the platform is shown about to be removed by a crane.

As shown in FIG. 1, a conventional offshore platform is shown, designated as O/P, and composed of a deck D and supporting piles P which are surrounded by concentric cylindrical jackets J. The offshore platform is usually supported by 4, 6, or 8 or more such piles that are embedded into the seabed floor F well below the mudline M. The piles are cylindrical steel pipe of about 8–72 inches in diameter with wall thicknesses of ½ to 3 inches. The piles P are embedded perhaps hundreds of feet below the mudline M and into the seabed floor F. The jacket J, however, extends from the deck D of the offshore platform O/P and terminates just at or above the mudline M.

As shown in FIG. 1, the top portion of the offshore platform O/P is removed well above the surface S of the water W. This removal is done by conventional means and does not form a portion of this invention. A barge B having a conventional crane C is shown floating on the surface S. The crane may be of substantial size capable of handling weights of 7500 tons or greater and, as shown, is removing the deck D of the offshore platform O/P to expose the upper portion of the jacket J and the pile P. The portion of the jacket J and the pile P that remains after removal of the deck is shown in the cross-sectional view of FIG. 2.

Figure 2:
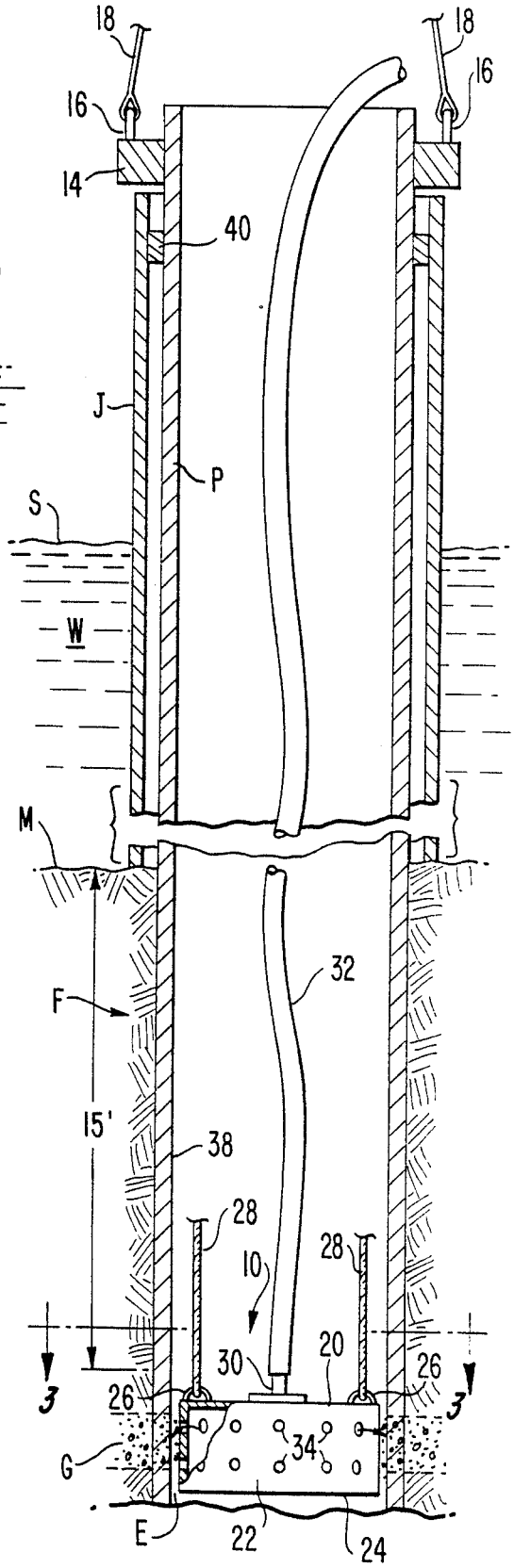
FIG. 2 is a cross-sectional view broken away illustrating the cannister in position and connected to a hose for pressurizing gas. Also shown more clearly is the jacket surrounding the pile to the mudline and the collar secured to the pile for providing tension on the pile.

Once the deck D of the offshore platform O/P has been removed, the internal volume of the pile must be evacuated of water and mud in order to permit the cannister 10 to be lowered down below the 15 feet limit below the mudline M. Also the presence of excess moisture would be a problem in the proposed fragmentation environment around the pile because moisture would freeze solid and could actually insulate the pile from the colder liquified gas. FIGS. 1 and 2 depict the 15 foot requirement below the seabed in order to achieve successful removal of the pile.

The evacuation of the mud and water within the pile P is accomplished by any suitable means such as by the use of an airlift L operated from the barge B. The airlift L, as best shown in FIG. 1, includes a conduit or hose 12 that extends downwardly as shown in FIG. 1 to well below the 15 foot limit terminating at the point T within the pile P. Upon the application of high pressure air, as shown in FIG. 1, bubbling out from the hose 12 at point T and upwardly through the pipe P, all mud and water will be evacuated from the pile down to about the point T, but importantly well below the stated 15 foot requirement. The evacuated water and mud are shown at D being spilled up over the top of the pile and back into the water W. Obviously no pollution occurs to the environment by reason of returning the water and mud from the ocean floor back to the surface of the water where it will filter down again to the bottom.

During this period of time, in one embodiment of the invention the pile P may have a collar 14 secured to its upper end that may be suitably secured, as by welding. The collar may be formed as a ring that is fully surrounding the pile P or the collar 14 may be discontinuous. It is desirable, also, that there be gripping means such as the padeyes 16 positioned on the collar 14 to receive a suitable cable 18 that may be secured to a derrick or a crane such as C on the boat or barge B. This collar should be of sufficient outside diameter so as to be greater than the outside diameter of the jacket J so that, upon fragmentation, the collar will prevent the pile from dropping down into the jacket, and will permit the recovery of the pile by the cables 18 secured to the padeyes 16.

Figure 3:
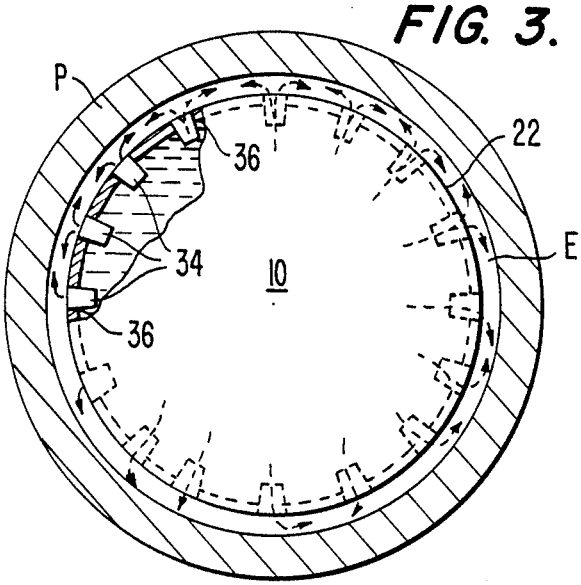
FIG. 3 is a cross-sectional view taken along lines 3—3 of FIG. 2 and illustrating the top of the cannister in position within the piling and filled with liquified gas being sprayed out between the cannister and the piling to chill the piling to embrittlement temperature or below.

The container or cannister 10, optionally used in one facet of the present invention and best shown in both FIGS. 2 and 3, can vary in volume as required from 10 or 50 gallons to several hundred gallons. The cannister may be composed of ceramic, glass or other material capable of withstanding extremely low temperatures of below 350° below zero, which is the temperature of liquid nitrogen, preferably used as the liquified gas. The composition of the cannister 10 is not important, it being only significant that it have the capability of withstanding these extremely low temperatures.

The cannister, as shown, is provided with a top 20, sides 22 and a bottom 24. The shape of the container is preferably in the form of a cylinder but according to the broadest aspects of the present invention, it is preferable that when used, the cannister be shaped in accordance with the shape of the object or portion of the object to be chilled and brought to an embrittlement temperature or below for fragmentation. Where used for fragmentation of a pile, it is preferable that the diameter of the cannister be about one inch to 6 inches or more less than internal diameter of the pile, to form spacing E as shown in FIGS. 1 and 2.

The cannister 10 is also provided with a plurality of padeyes 26 positioned conveniently on the top 20 of the cannister and preferably at its periphery to support cable means 28 for raising and lowering the cannister through the pile P. The top of the cannister is also fitted with an inlet nozzle 30 communicating with the interior of the cannister and to which is secured a conduit means in the form of hose 32 that extends up through the pile P and out to the barge B.

This hose is used to provide the pressurizing gas, preferably in the form of gaseous nitrogen, to the cannister, which, when containing liquified gas, sprays the liquified gas out into contact with the pile P through nozzles 34. These nozzles 34 are shown in FIG. 2 and FIG. 3 and are preferably directed inwardly as best shown in the cross-section cutaway of FIG. 3 and formed from suitable material such as Teflon. These nozzles 34 are positioned within suitable openings 36 evenly distributed in the side 22 of the cannister 10.

It is preferable that the liquified gas be any non-toxic, non-oxidizable gas such as nitrogen, which is the gas of choice. Argon or one of the many chlorofluoro hydrocarbons used as refrigerants, or an aerosol propellant such as the Freons or Genetrons, including chlorotrifluoro methane having a boiling point of −114.6° F. at a pressure of 760 mm, may be suitable, although a bit more expensive.

The pressurizing gas to be admitted through hose 32 need not be the same gas that is liquified and contained in the cannister 10, but it is likely that since nitrogen is found to be the best and most preferred gas, that nitrogen would be both the liquified gas, and also the pressurizing gas that sprays the liquid nitrogen out the nozzles 34.

In use, the deck D of the offshore platform is removed as shown in FIG. 1 to expose the upper end of the pile P at which time the line L is lowered to the desired depth shown as point T. Air passing through the line L provides the airlift to evacuate the interior of the pile P below the 15 foot level of the mudline. The cannister 10 then may be filled with the liquified gas at the surface on the barge B and then lowered by cables 28 through the pile down to the point well below the 15 foot level, or it is possible that the cannister 10 be filled through the inlet nozzle 30 prior to the pressurizing gas being forced down in the hose 32 to spray the liquid nitrogen out nozzles 34 into spacing E and into contact with the inside of the pile P.

As shown, the cannister is slightly smaller in diameter than the inside of the pile. Even though the pile may be from 8 inches to 72 inches in diameter with a wall thickness of ½ to 3 inches thick, it is possible to chill it to the embrittlement temperature of steel, −55°. Obviously the thicker the wall and the larger the size of the diameter of the pile, the greater the capacity of the cannister in order to have sufficient liquified gas sprayed out to chill the wall of the pile to or below the embrittlement temperature.

It is believed that if the cannister is shaped to conform to the environment of the interior of the pile, yet allowing for spacing E, after the pile has been evacuated, a space between the sides 22 of the cannister and the inside wall 38 of the pile P will be sufficient to hold the liquified gas in contact with the pile until the liquified gas has vaporized and drawn its heat of vaporization from the walls of the pile within the area G to be fragmented. While this distance or spacing is not critical, it should be sufficient to allow the liquified gas to be sprayed out of the Teflon nozzles 34 and retained until vaporized sufficiently to chill the pile P.

As a specific example, it may be assumed that the steel pile to be embrittled and fragmented is 1 inch thick and 30 inches in diameter and is to be removed through the jacket J. An airlift L removes all the water and mud to point T, which is 20 feet or more below the mudline M to assure at least the 15 foot margin required. A glass-ceramic cannister with Teflon nozzles and containing about 50 gallons of liquid nitrogen at −350° F. and shaped to be 4 inches in diameter less than the inside diameter of the pile is lowered by the cables 28 to the position shown in FIG. 2. At that time, gaseous nitrogen pressurizes the liquid nitrogen out in about 15 seconds to 20 minutes; preferably about 10 to 20 minutes later the steel pile is at the embrittlement temperature of −55° F. or below. The pile is ready to be fragmented from application of sufficient force, that may be induced along the length of the pile, but preferably, by a fragmentation tool, such as generally shown in FIGS. 6, 7, 9 and 11 at 39 and 39A.

One method for applying the necessary force to cause fragmentation of the pile in the embrittled area is also one of the simplest and most readily available. It has been found that the hammer pile driver H, as shown in FIG. 5, generally used to install the pile into the seabed, will also provide a sufficient force, even up to 1,000,000 lbs., though that magnitude is more than required to produce the compressive shock necessary to cause fragmentation.

Figure 4:
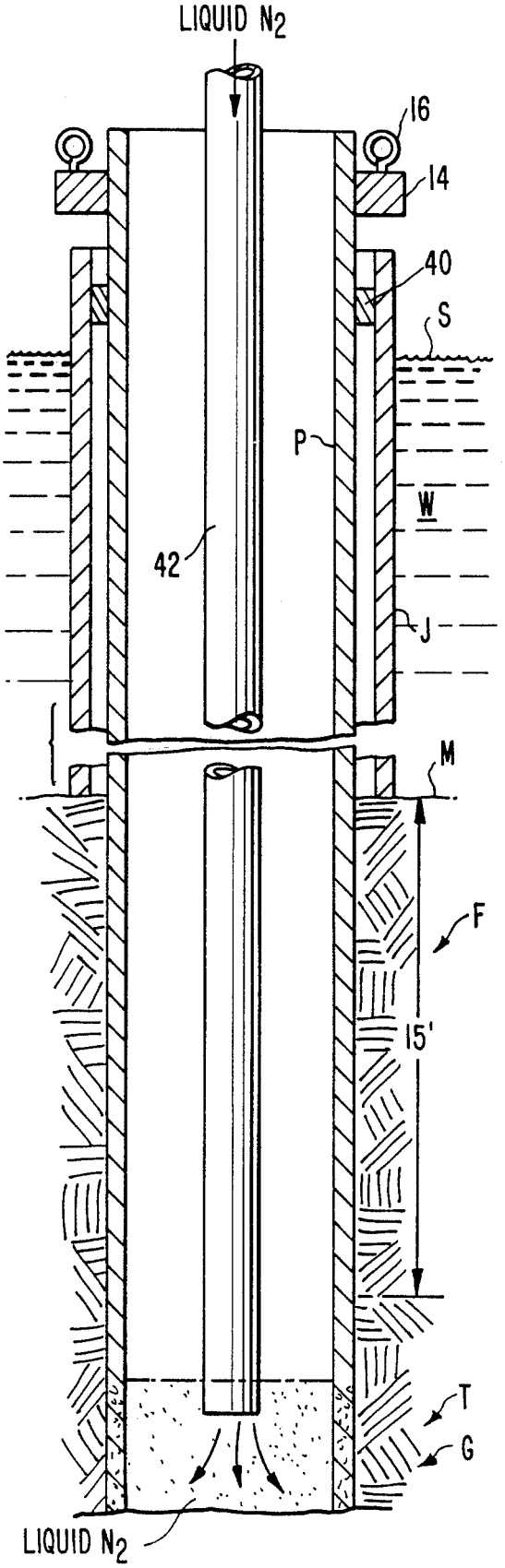
FIG. 4 is a cross-sectional view partly broken away illustrating an alternate embodiment of the present invention wherein a conduit is lowered into the environment of the pile to be fragmented.

The hammer pile driver H is conventional and well known and requires no further description. In operation the hammer pile driver H is provided with an anvil A positioned atop the pile P. By the usual action, hammer H strikes the anvil A and forces the pile downwardly with a longitudinal force. The difference in height of pile P between FIGS. 4 and 5 illustrates schematically the lowering of the pile upon fragmentation occurring at R in the wall of the pile P. Before or just at the initiation of fragmentation of the wall of the pile, the cannister can be retrieved with cables 28. Even if the cannister were to remain in the pile after fragmentation, it can be safely retrieved. The descent of the pile due to fragmentation, as shown in FIG. 5, is limited by the collars 14 abutting the top of the pile P. The cable 18 can pull the pile up through the jacket J after the fragmentation.

The spacers 40 between the jacket J and the pile P may have to be removed in order to lift the pile P leaving the jacket in place. If the spacers are not removed, then both the pile P and the jacket J are raised together for removal. The jacket may later be retrieved from the ocean floor, or it may be held in place for subsequent removal in a manner similar to the use of crane C and cables 18.

In another alternative embodiment of the present invention, as shown in FIGS. 4 and 5, the liquified gas, shown to be nitrogen, after evacuation as previously described, is injected into the environment G of the pile P to be embrittled and fragmented. This injection is made through conduit 42 that may be stainless steel tubing or any other suitable tubular member.

The liquified gas is directed to a location below the minimum depth permissible for removal of the embedded pile, as shown in FIG. 4 at T. The amount of the liquified gas injected could be from 0.5 feet to 10 feet deep as measured from about point T along the axis of the pile. Preferably, 5 feet to 10 feet depth is sufficient to create a substantial length of pile that is embrittled. The length of pile being embrittled is not critical nor is the depth of the liquified gas, it being only important to have at least substantially all of the circumferential band of the pile P in the environment G being embrittled.

The amount of the liquified gas that is to be used depends upon the diameter of the pile P. The amount may vary between 500 to 5,000 gallons, or even in a wider range. For instance, a 72 inch pile may require up to the 5,000 gallon amount to achieve an acceptable depth. The time for liquified gas contact o cause embrittlement is within the ranges previously described.

It should be understood that this invention has applicability to various other sizes and shapes of structure and is not limited to the use on a pile as has been specifically described. The cannister or the pipe conduit, for instance, could be shaped in any manner to fit around or inside of an object to be embrittled and then fragmented. It is preferable that the environment around such an object or a portion of an object be evacuated of water and any mud and retaining such an impervious environment for proper injection of the liquid gas. However, it is conceivable in the broadest aspects of the invention that the most desirable element of the invention is the sufficient contact of the liquified gas with the surface of the object to be fragmented so as to bring about embrittlement. Thereafter, possibly through its own weight, but most likely only through the application of other force, the embrittled metal will be fragmented. This invention should also be effective irrespective of the composition of the object to be fragmented. Alloys, other metals or even organic plastic materials when encountered could, if desired, be successfully fragmented within the principles of this invention.

In FIGS. 6, 7, 8, 9 and 11, there is shown a new and different embodiment of an apparatus for fragmenting the submerged object, in particular, a pile submerged in the sea bottom. This fragmentation tool 39, as shown in FIG. 6, and the modification of the fragmentation tool, as shown at 39A in FIGS. 7, 8, 9 and 11, are designed to effectively and efficiently fragment the pile or other submerged object after it has been embrittled to form an embrittled section or area R as shown in the drawings. The fragmentation tool 39 is composed of several important elements including a propulsion unit shown generally at 44 and a plurality of barrels or elongated tubes shown generally at 46 that house a plurality of anvils 48 that are received within the tubes 46.

The propulsion unit 44 is a conventional propulsion unit available in the industry for a variety of purposes. The propulsion unit includes a gas chamber housing 50 having a core 52 to receive a gas generating fuel cell. The gas generating fuel cell 54 is also a conventional material available from a number of domestic manufacturers and is usually, though not necessarily, a flammable solid of a type well known in the industry. A firing head 56 is secured to the top of the gas chamber housing 50 in any suitable manner such as threads, not shown. The firing head 56 includes electrical connections 58 to connector 60 that are in electrical contact with the primer 62. The connectors 60 are in contact with a convenient power source and ground. The gas chamber housing 50 also includes a bleed-off port 64.

As shown in FIG. 6, the lower end of the gas generating housing 50 of the propulsion unit 44 is in fluid communication with the elongated barrels or tubes 46 that may be a single elongated tube as shown having open ends 66 that face the embrittled area R. Positioned within and sized to fit snugly in the tubes 46 are anvils 48. The anvils 48 are preferably steel blocks that may be from an inch to five or more inches long and an inch to six inches in diameter, if cylindrical, though a spherical shape for the anvils is very desirable. The anvils are composed of a contact face 68 and a propulsion face 70. The contact face 68 may be shaped to conform approximately to the curvature of the inside surface 72 of the pile P. The purpose of such shaping of the contact face of the anvil is to obtain the benefit of maximum surface contact and therefore have force spread more evenly about the contacted area when the anvil would strike the pile. If the anvil is spherically shaped, as may be desired, the spherical shape should have a circumferential curvature that comes reasonably close to approximating the curvature of the inside surface 72 of the pile P.

The anvils of FIG. 6 are shown to be opposed in their respective barrels 46 and are preferably provided with at least one O-ring as a gas sealing means between the internal surface of the barrel and the outer circumference of the anvil. The number of O-rings is not critical as long as the purpose is served to limit any gas leakage that might occur between the anvil and the bore of the tubes 46.

Connecting the opposed anvils is a frangible rod 76. The rod 76 is preferably cold rolled steel rod that is cut into a a length in accordance with the desired distance between the opposed anvils 48. Each end of the rod 76 may be threaded to be received into complimentary threaded bores in the anvil. As shown in FIG. 6, the frangible rod 76 has a reduced neck portion at 78. The reduction in diameter of the rod 76 as shown in 78 is for the purpose of controlling the point of rupture. The rod is designed to fail at around 10,000 pounds of tension. Of course, this could be much greater or lesser depending upon the propulsion unit and the diameter and thickness of the pile.

The fragmentation tool 39 also is provided with supporting means 80 in the form of a hook-and-eye arrangement 82 in which the eye is secured to the outer surface of the tube at 84. A chain 86 or other flexible means is secured at the hook-and-eye 82 and extends up through the pilé P to the surface of the water in order to enable the fragmentation tool to be raised or lowered within the pile and to be positioned at the level of the embrittlement area R.

In the embodiment of FIGS. 7, 9 and 11, there is shown the elongated tubes 46 in a cruciform shape at 39A. Essentially the elongated tubes 46 are radially disposed and are joined at the ends opposite to the open end 66 in a junction in which there is fluid communication among each of the tubes 46.

In the embodiment of FIG. 7, as distinguished from that of FIG. 9, the means for controlling and timing the propulsion of the anvils 48 is shown. The FIG. 7 modification, shown in part in an exploded view in FIG. 8, is a timing and control means enabling the release and therefore propelling of the anvils out of the tubes 46 at the same time.

This time and controlled release is accomplished by reason of the use of a separable coupler 88. The separable coupler includes two identical parts 90, preferably having a cylindrical shape wherein at one end the frangible rod 76 is attached at 92 by suitable threads through the frangible rod 76. The opposed anvils 48 secured to the rod 76 are slidably engaged with the internal bore of the tube 46. The rod 76 secured to the anvil at one end and the single half 90 of the coupler 88 at the other end need not be necked down as at 78, however, the rod may be the same steel rod 76 without the reduced portion 78 that is shown in FIG. 6. The other two anvils secured to a rod 76 do have interposed the reduced portion 78 to enable the rod 76 to rupture when sheared by the separable coupler 88.

As shown in FIG. 8, the separable coupler 88 has a complimentary cutaway portion 92 facing each of the identical separable coupler parts 90 and also includes a bore 94 through which the rod 76 is passed.

When assembled, each of the anvils is in place in the elongated tube facing outwardly towards the open end 66 of each of the tubes and pointed in the direction of the embrittled section R. Upon ignition of the propulsion unit 44, the gas generated reaches increasingly higher pressure on the propulsion faces 70 of each respective anvil 48. When that pressure approaches the elastic limit of the rod 76, and shear forces created by the pressure on the transverse anvils 48 that are attached to each separable coupler portion 90 and acting on the reduced portion 78 are sufficient to rupture the frangible rod 76. At the time of failure of the rod all of the anvils will be propelled outwardly from the elongated tube and into contact with the embrittled area R. The separable coupler parts 90 are not released from the anvil to which they have been secured by the rod 76, but rather also pass through the tube out towards the embrittled area.

Thus, the reduced portion 78 of the rod 76 controls the movement of the anvils in accordance with the diameter and type of material from which the rod is made. Whatever the impact force desired to be created by the anvil as it exits the tube can be achieved by a combination of the type of material and diameter of the frangible rod at its weakest point 78 and of course also the magnitude and type of the gas generating fuel cell 54.

In the embodiment of FIG. 9, there is disclosed the barrel and anvil combination in a cruciform shape similar to that shown in FIG. 7 except for the timing means, which in FIG. 9 is in the shape of a frangible disc 96. As shown in FIG. 9, the frangible disc 96 is positioned at the juncture of the tubes 46. In this embodiment the anvils 48 are not interconnected but are positioned snugly within the bore of the tubes 46 by reason of the O-rings 74 forming the sealing means in a manner identical to that of the embodiment of FIGS. 6 and 7. The propulsion unit 44 is again the same as that in the previous embodiments except that the frangible disc 96 is positioned at the base of the gas chamber housing 50 and only when the pressure produced by the ignited gas generating fuel cell 54 is sufficient to rupture the disc 96 is there communication between the interior of the barrels 46 in the area of the junction and the gas chamber 50. Upon rupture of the frangible disc 96, the gas pressure propels each of the anvils 48 out from its respective tube 46 and open end 66 into forceful contact with the embrittled section R to cause such a shock as to fragment the piling. The action of such anvils upon the embrittled section is shown in FIG. 11 where the pile in the embrittled section R has been essentially shattered to fragments freeing the upper portion of the piling from the deeply embedded lower portion to enable the piling to be easily removed from the jacket J.

One of the important benefits of the manner of fragmenting the piling in accordance with the present invention, is that the remaining portions of the pile are not distorted to the extent that the pile would be unable to be raised from within the concentric jacket J. This is an important feature of the present invention and has added significantly to its value in removing the submerged piling from the seabed.

In FIG. 10, there is disclosed an optional apparatus to apply tension to the pile P prior to the activation of the fragmentation tool.

It has been found that, depending upon the length of the pile and its thickness and diameter, the enormous weight of the pile over the embrittled area may make the metal in the embrittled area more dense due to the compressive forces of the weight and thus less susceptible to the effect of the fragmentation force from the anvils. To alleviate this compressive force and the attendant increase in density, it has been found that applying a tension force on the pile P will aid the fragmentation tool in performing its purpose and successfully fragment the embrittled area. In FIG. 10, the tensioning apparatus 98 is disclosed to apply tension force to the pile P using the jacket J as the base. One or more expansion apparatus 100 that may be in the form of hydraulic rams 102 that are uniformly positioned around the circumference of the pile P.

The rams have opposed pistons (not shown) with an upper end 104 and a lower end 106 that may be separated by hydraulic action on the pistons. The upper end 104 is secured to a padeye 108 welded as at 110 to the pile and secured as by conventional bolt 112 to the upper end 104 of the ram 102. The lower end 106 of the expansion means 102 is similarly attached by bolt 112 to lower padeyes 114. A stabilizing means in the form of a collar 116 is secured to the base of the ram cylinder 102 and secured by bracket 118 to the pile as by welding at 120. The purpose of the collar and bracket 116 and 118 respectively is to stabilize the ram 102 and keep it aligned with the axis of the pile P during expansion. To provide full usefulness of the force of any expansion of the ram 102 it is particularly desirable that the axis of the ram be essentially parallel to the axis of the pile P.

A centering means 120 in the form of a collar or ring 122 is positioned between the internal surface of the jacket J and the outer diameter of the pile P to maintain the pile P centered within the surrounding jacket J. Wings 124 secured to the upper surface of the collar 122 bear against the outer circumference of the pile P to aid in stabilizing and centering the pile P within the jacket J.

In view of the foregoing description, it is believed that the objects of the invention have been attained and that the invention should be limited solely and exclusively in scope by the following claims in which,

We claim:

1. A method for removing support structure including metal piles embedded within a seabed comprising:

dislodging at least a portion of the environment for at least one of said piles below the mudline of said seabed, injecting a liquified gas into the environment of the contact of said pile with said seabed in a sufficient amount to embrittle at least a portion of said pile in said environment when said liquified gas is in contact with said pile, contacting said pile within said environment with said liquified gas for a sufficient time to cryogenically embrittle said pile, fragmenting said pile upon said embrittlement and within said environment, raising said pile and removing said pile from embedment in said seabed.

2. The method of claim 1 including, evacuating substantially the water and mud in said environment below said mudline down to a preselected level.

3. The method of claim 2 including, air lifting said water and mud substantially to the sea water surface to evacuate said environment within said pile.

4. The method of claim 1 including, applying a force to said pile to effect said fragmenting.

5. The method of claim 1 including, evacuating substantially the water and mud in said environment below said mudline down to a preselected level, and applying a force to said pile to effect said fragmenting.

6. The method of claim 1 including, evacuating substantially the water and mud in said environment below said mudline down to a preselected level, air lifting said water and mud substantially to the sea water surface to evacuate said environment within said pile, and applying a force to said pile to effect said fragmenting.

7. The method of claim 1 including, evacuating substantially the water and mud in said environment below said mudline down to a preselected level, air lifting said water and mud substantially to the sea water surface to evacuate said environment within said pile, and applying a force to said pile to effect said fragmenting.

8. The method of claim 1 including, inserting a conduit into said environment to conduct liquified gas into said environment for contact with said pile.

9. The method of claim 1 including, evacuating substantially the water and mud in said environment below said mudline down to a preselected level, and inserting a conduit into said environment to conduct liquified gas into said environment for contact with said pile.

10. The method of claim 1 including, injecting said liquified gas into said environment to a depth of at least 0.5 feet of liquified gas.

11. The method of claim 1 including, injecting said liquified gas into said environment to a depth of 0.5 to 10 feet of liquified gas.

12. The method of claim 1 including, said evacuating including the gas lifting of said water and mud substantially to the sea water surface.

13. The method of claim 1 including, evacuating substantially the water and mud in said environment below said mudline down to a preselected level, inserting a conduit into said environment to conduct liquified gas into said environment for contact with said pile, and injecting said liquified gas into said environment to a depth of at least 0.5 feet of liquified gas.

14. The method of claim 13 including, said liquified gas being nitrogen.

15. The method of claim 4 including, applying said force longitudinally along said pile in a compressive shock to fragment said pile.

16. The method of claim 15 including, applying said force with a hammer pile driver affixed to the end of the pile.

17. The method of claim 1 including, evacuating substantially the water and mud in said environment below said mudline down to a preselected level, inserting a conduit into said environment to conduct liquified gas into said environment for contact with said pile, injecting said liquified gas into said environment to a depth of at least 0.5 feet of liquified gas, applying a force to said pile to effect said fragmenting, and applying said force with a hammer pile driver affixed to the end of the pile.

18. The method of claim 1 including, raising said pile longitudinally along its axis following fragmentation.

19. The method of claim 1 including, said injecting including 50 to 5,000 gallons of liquid nitrogen.

20. The method of claim 1 including, evacuating substantially the water and mud in said environment below said mudline down to a preselected level, inserting a conduit into said environment to conduct liquified gas into said environment for contact with said pile, injecting said liquified gas into said environment to a depth of at least 0.5 feet of liquified gas, said injecting including 50 to 5,000 gallons of liquid nitrogen, applying a force to said pile to effect said fragmenting, applying said force with a hammer pile driver affixed to the end of the pile, and raising said pile longitudinally along its axis following fragmentation.

21. The method of claim 1 including, providing a container to hold said liquified gas, supplying liquified gas to said container, lowering said container into said environment, directing said liquified gas from said container onto said pile in said environment to embrittle said pile cryogenically.

22. The method of claim 21 including, said container being a cannister having a plurality of nozzles for spraying said liquified gas, spraying said liquified gas from said cannister onto said pile within said environment to chill a portion of said pile down to at least the embrittlement temperature of said pile.

23. The method of claim 21 including, lowering said container within said pile to a depth below said mudline.

24. The method of claim 21 including, pressurizing said container with a pressurizing gas to force said liquified gas out of said container into said environment for contact with said pile.

25. The method of claim 1 including, said liquified gas being selected from the group consisting of nitrogen, argon and fluorochlorohydrocarbons or other non-oxidizing gases.

26. The method of claim 24 including, said pressurizing of said container being with a pressurizing gas, said pressurizing gas and said liquified gas being selected from the group consisting of nitrogen, argon and fluorochlorohydrocarbons or other non-oxidizing gases.

27. The method of claim 21 including, securing a hose to said container from the surface of the sea, directing a pressurizing gas through said hose into said container to force said liquified gas out of said container.

28. The method of claim 1 including, securing a crane line to the top of said pile to provide tension to said pile and permit said pile to be removed upon fragmentation.

29. The method of claim 1 including, said support structure including a jacket around said pile and substantially concentric therewith, and removing said pile from within said jacket following fragmentation of said pile.

30. The method of claim 29 including, securing a crane line to the top of said pile to provide tension to said pile and permit said pile to be removed upon fragmentation, and removing securing spacers between said pile and said jacket.

31. The method of claim 1 including, evacuating the water and mud in said environment below said mudline down to a preselected level, air lifting said water and mud substantially to the water surface to evacuate said environment within said pile, providing a container to hold said liquified gas, supplying liquified gas to said container, lowering said container into said environment, and directing said liquified gas from said container onto said pile in said environment to embrittle said pile cryogenically.

32. The method of claim 1 including, evacuating the water and mud in said environment below said mudline down to a preselected level, providing a container to hold said liquified gas, supplying liquified gas to said container, lowering said container into said environment, said container being a cannister having a plurality of nozzles for spraying said liquified gas, and spraying said liquified gas from said cannister onto said pile within said environment to chill said pile down to at least the embrittlement temperature of said pile.

33. The method of claim 1 including, evacuating the water and mud in said environment below said mudline down to a preselected level, air lifting said water and mud substantially to the water surface to evacuate said environment within said pile, providing a container to hold said liquified gas, supplying liquified gas to said container, lowering said container within said pile below said mudline into said environment, directing said liquified gas from said container onto said pile in said environment to embrittle said pile cryogenically, said container being a cannister having a plurality of nozzles for spraying said liquified gas, spraying said liquified gas from said cannister onto said pile within said environment to chill said pile down to at least the embrittlement temperature of said pile.

34. The method of claim 1 including, evacuating the water and mud in said environment below said mudline down to a preselected level, providing a container to hold said liquified gas, supplying liquified gas to said container, lowering said container within said pile to a depth below said mudline, directing said liquified gas from said container onto said pile in said environment to embrittle said pile cryogenically, and pressurizing said container with a pressurizing gas to force said liquified gas out of said container into said environment for contact with said pile to embrittle said pile.

35. The method of claim 1 including, evacuating the water and mud in said environment below said mudline down to a preselected level, providing a container to hold said liquified gas, supplying liquified gas to said container, lowering said container within said pile to a depth below said mudline, pressurizing said container with a pressurizing gas to force said liquified gas out of said container into said environment for contact with said pile, to embrittle said pile cryogenically, and said pressurizing gas and said liquified gas being selected from the group consisting of nitrogen, argon and fluorochlorohydrocarbons or other non-oxidizing gases.

36. The method of claim 1 including, evacuating the water and mud in said environment below said mudline down to a preselected level, providing a container to hold said liquified gas, supplying liquified gas to said container, lowering said container within said pile to a depth below said mudline, directing said liquified gas from said container onto said pile in said environment to embrittle said pile cryogenically, pressurizing said container with a pressurizing gas to force said liquified gas out of said container into said environment for contact with said pile, said pressurizing gas and said liquified gas being selected from the group consisting of nitrogen, argon and fluorochlorohydrocarbons or other non-oxidizing gases, and securing a crane line to the top of said pile to provide tension to said pile and permit said pile to be removed upon fragmentation.

37. The method of claim 1 including, evacuating the water and mud in said environment below said mudline down to a preselected level, air lifting said water and mud substantially to the water surface to evacuate said environment within said pile, providing a container to hold said liquified gas, supplying liquified gas to said container, lowering said container within said pile to a depth below said mudline, pressurizing said container with a pressurizing gas to force said liquified gas out of said container into said environment for contact with said pile, said pressurizing gas and said liquified gas being selected from the group consisting of nitrogen, argon and fluorochlorohydrocarbons or other non-oxidizing gases, securing a crane line to the top of said pile to provide tension to said pile and permit said pile to be removed upon fragmentation, said support structure including a jacket around said pile and substantially concentric therewith, and removing said pile from within said jacket following fragmentation of said pile.

38. The method of claim 1 including, said liquified gas being nitrogen.

39. The method of claim 21 including, said amount of liquified gas being between 20 and 500 gallons.

40. The method of claim 38 including, the time for contacting said pile with said liquified gas is between about 5–40 minutes.

41: The method of claim 40 including, the time being between 10 and 25 minutes.

42. The method of claim 1 including, evacuating the water and mud in said environment below said mudline down to a preselected level, providing a container to hold said liquified gas, supplying liquified gas to said container, lowering said container within said pile to a depth below said mudline, pressurizing said container with a pressurizing gas to force said liquified gas out of said container into said environment for contact with said pile, said pressurizing gas and said liquified gas being selected from the group consisting of nitrogen, argon and fluorochlorohydrocarbons or other non-oxidizing gases, said amount of liquified gas being between 20 and 500 gallons, and the time for contacting said pile with said liquified gas is between about 5–40 minutes.

43. The method of claim 1 including, said support structure being for an offshore oil rig having a deck, and removing said deck by severing said piles between the water surface and the level of said deck.

44. The method of claim 1 including, said support structure being for an offshore oil rig having a deck, removing said deck by severing said piles between the water surface and the level of said deck, evacuating the water and mud in said environment below said mudline down to a preselected level, providing a container to hold said liquified gas, supplying liquified gas to said container, lowering said container within said pile to a depth below said mudline, pressurizing said container with a pressurizing gas to force said liquified gas out of said container into said environment for contact with said pile, and said pressurizing gas and said liquified gas being selected from the group consisting of nitrogen, argon and fluorochlorohydrocarbons or other non-oxidizing gases.

45. The method of claim 44 including, said liquified gas being nitrogen.

46. A cannister for use in removing support structures including metal piles embedded within a seabed comprising:

said cannister having a body of predetermined internal volume for holding liquified gas, said body being formed from a top, sides and a bottom sized to fit within one of said piles, said cannister being composed of material capable of withstanding low temperatures without embrittlement, said sides having nozzle means to discharge liquid contained in said cannister, inlet means positioned on said body to permit the pressurizing gas to be admitted to said internal volume, support means on said body for raising and lowering said cannister within at least one of said piles, and the construction and arrangement being such as to permit said cannister containing liquified gas to be forced out of the nozzle means by the pressurizing gas to contact said pile for chilling the pile to or below its embrittlement temperature resulting in fragmentation of the pile.

47. The cannister of claim 46 including, said body of said cannister being shaped to fit within the pile.

48. The cannister of claim 46 including, said body of said cannister being cylindrical.

49. The cannister of claim 46 including, conduit means secured to said inlet means and of sufficient length to extend above the water surface.

50. The cannister of claim 46 including, said support means including a plurality of padeyes for receiving a cable means to raise and lower the cannister within said pile.

51. The cannister of claim 46 including, said body of said cannister being shaped to fit within the pile, conduit means secured to said inlet means and of sufficient length to extend above the water surface, and said support means including a plurality of padeyes for receiving a cable means to raise and lower the cannister within said pile.

52. The cannister of claim 46 including, said body of said cannister being cylindrical, conduit means secured to said inlet means and of sufficient length to extend above the water surface, and said support means including a plurality of padeyes for receiving a cable means to raise and lower the cannister within said pile.

53. Apparatus for use in removing support structures including metal piles embedded within a seabed comprising:

a cannister having a body of predetermined internal volume for holding liquified gas, said body being formed from a top, sides and a bottom sized to be lowered into one of said piles, said cannister being composed of material capable of withstanding low temperatures without embrittlement, said sides having nozzle means to discharge liquid contained in said cannister, inlet means positioned on said body to permit a pressurizing gas to be admitted to said internal volume to discharge said liquified gas, support means on said body for raising and lowering said cannister within at least one of said piles, cable means secured to said support means to raise and lower said cannister through said pile, conduit means secured to said inlet means and of sufficient length to extend above the water surface, and the construction and arrangement being such as to permit said cannister to be lowered within a pile for liquified gas to be forced out of the nozzle means of said cannister by the pressurizing gas in order to contact said pile for chilling the pile to or below its embrittlement temperature allowing subsequent fragmentation of the pile and removal thereafter.

54. The apparatus of claim 53 including, said support means including a plurality of padeyes for receiving a cable means to raise and lower the cannister within said pile.

55. The apparatus of claim 53 including, collar means secured to the upper end of said pile, cable holding means secured to said collar means for receiving a second cable means for providing tension to said pile and to raise said pile from said seabed.

56. The apparatus of claim 53 including, said body of said cannister being shaped to fit within the pile, and said support means including a plurality of padeyes for receiving a cable means to raise and lower the cannister within said pile.

57. The apparatus of claim 53 including, said body of said cannister being shaped to fit within the pile, said support means including a plurality of padeyes for receiving a cable means to raise and lower the cannister within said pile, said cannister having a body of predetermined internal volume for holding liquified gas, said body being formed from a top, sides and a bottom sized to fit within one of said piles, said cannister being composed of material capable of withstanding low temperatures without embrittlement, said sides having nozzle means to discharge liquid contained in said cannister, inlet means positioned on said body to permit the pressurizing gas to be admitted to said internal volume, support means on said body for raising and lowering said cannister within at least one of said piles, cable means secured to said support means to raise and lower said cannister through said pile, conduit means secured to said inlet means and of sufficient length to extend above the water surface, and the construction and arrangement being such as to permit said cannister to be lowered within said pile for liquified gas to be forced out of the nozzle means of said cannister by the pressurizing gas in order to contact said pile for chilling the pile to or below its embrittlement temperature allowing subsequent fragmentation of the pile and removal thereafter.

58. A method of removal of large metal objects embedded in or substantially immobile on a seabed comprising:

dislodging at least a portion of the environment in contact with at least a portion of said object, injecting a liquified gas into said environment as dislodged in a sufficient amount to embrittle said object portion, contacting said object portion within said dislodged portion with said liquified gas for a sufficient time to cryogenically embrittle said object portion, fragmenting said object portion due to said embrittlement by application of force, and raising and removing the remaining nonfragmented object.

59. The method of claim 58 including, evacuating substantially the mud and water present in said environment prior to said injecting.

60. The method of claim 58 including, forming a substantially water impervious environment for the object portion to be fragmented prior to said injecting.

61. The method of claim 59 including, applying air to evacuate said mud and water.

62. The method of claim 59 including, said liquified gas being nitrogen.

63. An underwater fragmentation tool for use in a sea upon a submerged object having an embrittled area, comprising:

at least two anvils each having both a contact face for striking said object in said embrittled area and a propulsion face for receiving a propelling force to move each anvil in the direction of said embrittled area;

direction controlling means operative upon said anvils for directing and controlling the movement of said anvils toward the embrittled area;

propulsion means cooperating with said direction controlling means for applying a propelling force to said propulsion face of said anvils; and timing means for controlling the movement of said anvils, said timing means including a reduced diameter frangible rod connecting opposed anvils whereby, upon said fragmentation tool being positioned toward said embrittled area and said propulsion means being activated, the frangible rod retains the anvils within the tool for a predetermined time until a sufficient propulsion force is applied to the propulsion face of each anvil to rupture the frangible rod and move the contact face of each anvil into striking engagement with the embrittled area of said submerged object to cause fragmentation.

64. The fragmentation tool of claim 63 wherein, said direction controlling means includes an elongated tube having an open end facing said embrittled area and said tube housing at least one of said anvils.

65. The fragmentation tool of claim 63 including, support means secured to said tool for supporting said tool at a level below the surface of the sea.

66. The fragmentation tool of claim 64 including, at least one sealing means positioned between each said tube and each said anvil to control any leakage of the propelling force past said anvil while remaining in contact with said direction controlling means.

67. The fragmentation tool of claim 63 wherein said propulsion means includes a propellent charge.

68. The fragmentation tool of claim 64 including, a plurality of anvils, commensurate plurality of elongated tubes, a junction of said tubes opposite their respective open ends, said junction forming a fluid communication among said tubes.

69. The fragmentation tool of claim 63 including, said frangible rod being operable to control the movement of said anvils until gaseous pressure caused by said propulsion means reaches a predetermined level to rupture said frangible rod.

70. The fragmentation tool of claim 69 wherein, said frangible rod includes a rod portion of reduced tensile strength.

71. The fragmentation tool of claim 69 including, a plurality of anvils, said direction controlling means including, a commensurate plurality of elongated tubes each having an open end facing said embrittled area and each said tube housing an anvil.

72. The fragmentation tool of claim 63 including, coupling means positioned on said frangible rod, said coupling means being secured to at least one additional anvil whereby when said frangible rod ruptures, said coupling releases said additional anvil.

73. The fragmentation tool of claim 72 including, said coupling means having a shear means positioned thereon to shear said frangible rod.

74. The fragmentation tool of claim 72 including, said coupling means being composed of at least two separable portions, each said portion being secured to an anvil released upon the separation of said portions due to rupture of said frangible rod.

75. The fragmentation tool of claim 63 including, a plurality of anvils, said direction controlling means including, a commensurate plurality of elongated tubes each having an open end facing said embrittled area and each said tube housing an anvil, coupling means positioned on said frangible rod, said coupling means being secured to at least one additional anvil whereby when said frangible rod ruptures, said coupling releases said additional anvil.

said coupling means having a shear means positioned thereon to shear said frangible rod, said coupling means being composed of at least two separable portions, each said portion being secured to an anvil released upon the separation of said portions due to rupture of said frangible rod, and support means secured to said tool for supporting said tool at a level below the surface of the sea.

76. The fragmentation tool of claim 63 including, said submerged object being a pile supporting a superstructure, and said embrittled area being cryogenically embrittled, support means secured to said tool for raising or lowering said tool within said pile, a plurality of said anvils having each an axis mutually radially spaced and positioned in a plan transverse to the axis of said pile, and each said anvil having an elongated tube surrounding and housing each said anvil and having an open end for facing the embrittled area.

77. The fragmentation tool of claim 76 including, at least one sealing means between each said tube and each said anvil to control any leakage of the propelling force past said anvil while remaining in contact with said direction controlling means.

78. The fragmentation tool of claim 76 including, said frangible rod being operable to control the movement of said anvils until gaseous pressure caused by propulsion means reaches a predetermined level to rupture said frangible means.

79. The fragmentation tool of claim 78 wherein, said frangible rod includes a rod portion of reduced tensile strength.

80. The fragmentation tool of claim 78 including, coupling means positioned on said frangible rod, said coupling means being secured to at least one additional anvil whereby when said frangible rod ruptures, said coupling releases said additional anvil.

81. The fragmentation tool of claim 80 including, said coupling means having a shear means positioned thereon to shear said frangible rod.

82. The fragmentation tool of claim 81 wherein said coupling means is composed of at least two separable portions, each said portion being secured to an anvil released upon the separation of said portions due to rupture of said frangible rod.

83. The fragmentation tool of claim 63 wherein, said contact face is shaped to have maximum contact with said embrittled area.

84. The fragmentation tool of claim 83 wherein, said anvil is spherically shaped.

85. The fragmentation tool of claim 63 including sealing means positioned between said direction controlling means and said anvil to contain substantially all of said propelling force for moving said anvil.

86. The fragmentation tool of claim 85 wherein,
said sealing means includes O-rings positioned around each said anvil.

87. The fragmentation tool of claim 63, wherein
said frangible rod includes a reduced neck portion.

88. The fragmentation tool of claim 63, wherein
said contact face is blunt.

89. The fragmentation tool of claim 83, wherein
said contact face is blunt.

90. The fragmentation tool of claim 65, wherein
said support means comprises at least one chain connected to the tool for suspending the tool from above.

91. A method for fragmenting and thereafter removing a submerged structure embedded in or on a sea bottom, comprising:
contacting a portion of said structure with an embrittling agent for sufficient time to create an embrittled area on said structure,
positioning at least one anvil adjacent said embrittled area for striking said embrittled area,
propelling said at least one anvil with high propulsion force to strike said embrittled area,
directing the path of said at least one propelled anvil toward said embrittled area, and
impacting said embrittled are with said at least one anvil to fragment said embrittled area and permit removal of said structure.

92. The method of claim 91 wherein,
said embrittling agent is a cryogenic liquid.

93. The method of claim 92 wherein,
said cryogenic liquid is liquid nitrogen.

94. The method of claim 91 including,
generating a high propelling force for propelling said anvil, and
timing the propelling of each said anvil in accordance with the generation of a predetermined magnitude of propelling force.

95. The method of claim 91 including,
shaping the anvil to conform to the surface shape of said embrittled area to achieve maximum impact effect for fragmentation.

96. The method of claim 91 including,
dislodging at least a portion of the environment in contact with said embrittled area.

97. The method of claim 91 including,
housing each said anvil within an open ended elongated tube to direct the path of said anvil upon being propelled.

98. The method of claim 94 wherein,
providing a rupturable element to time the propelling of each anvil, and
rupturing said element prior to propelling each said anvil.

99. The method of claim 98 including,
providing a plurality of open ended elongated tubes to direct the path of said propelled anvil,
joining said tubes to form a fluid communicating junction among each of said tubes,
forming a propulsion force generating area,
separating said fluid communication junction from said propulsion generating area with a frangible disc, and
rupturing said disc upon said disc being subjected to sufficient propulsion force to propel said anvils.

100. The method of claim 91 including,
said embrittling agent is a cryogenic liquid,
generating a high propelling force for propelling said anvil, and
timing the propelling of each said anvil in accordance with the generation of a predetermined magnitude of propelling force.

101. The method of claim 91 including,
said embrittling agent is a cryogenic liquid,
generating a high propelling force for propelling said anvil,
timing the propelling of each said anvil in accordance with the generation of a predetermined magnitude of propelling force, and
shaping the anvil to conform to the surface shape of said embrittled area to achieve maximum impact effect for fragmentation.

102. The method of claim 91 including,
dislodging at least a portion of the environment in contact with said embrittled area,
said embrittling agent is a cryogenic liquid,
generating a high propelling force for propelling said anvil,
timing the propelling of each said anvil in accordance with the generation of a predetermined magnitude of propelling force, and
shaping the anvil to conform to the surface shape of said embrittled area to achieve maximum impact effect for fragmentation.

103. The method of claim 91 including,
said embrittling agent is a cryogenic liquid,
housing each said anvil within an open ended elongated tube to direct the path of said anvil upon being propelled,
generating a high propelling force for propelling said anvil,
timing the propelling of each said anvil in accordance with the generation of a predetermined magnitude of propelling force,
providing a rupturable element to time the propelling of each anvil, and
rupturing said element prior to propelling each said anvil.

104. The method of claim 91 including,
dislodging at least a portion of the environment in contact with said embrittled area,
said embrittling agent is a cryogenic liquid,
generating a high propelling force for propelling said anvil,
timing the propelling of each said anvil in accordance with the generation of a predetermined magnitude of propelling force,
shaping the anvil to conform to the surface shape of said embrittled area to achieve maximum impact effect for fragmentation,
housing each said anvil within an open ended elongated tube to direct the path of said anvil upon being propelled,
providing a rupturable element to time the propelling of each anvil, and
rupturing said element prior to propelling each said anvil.

105. The method of claim 91 including,
dislodging at least a portion of the environment in contact with said embrittled area,
said embrittling agent is a cryogenic liquid,
generating a high propelling force for propelling said anvil, timing the propelling of each said anvil in accordance with the generation of a predetermined magnitude of propelling force, shaping the anvil to conform to the surface shape of said embrittled area to achieve maximum impact effect for fragmentation, and dislodging at least a portion of the environment in contact with said embrittled area.

106. The method of claim 91 including, placing the pile in tension prior to fragmenting.

107. An underwater fragmentation tool for use in a sea upon a submerged object having an embrittled area, comprising:

at least one anvil having both a contact face for striking said object in said embrittled area and a propulsion face for receiving a propelling force to move said anvil in the direction of said embrittled area; and direction controlling means operative upon said at least one anvil for directing and controlling said anvil movement toward the embrittled area;

propulsion means cooperating with said direction controlling means for applying a propelling force to said propulsion face of said at least one anvil; and timing means secured to said tool and positioned for controlling the application of said propelling force to said propulsion face of said at least one anvil, said timing means being defined by a frangible disc interposed between said propulsion means and said at least one anvil whereby when such gaseous pressure reaches a predetermined level said frangible disc ruptures to expose the propulsion face of said at least one anvil to said propelling force applied by said gaseous pressure.

108. The fragmentation tool of claim 107 including, a plurality of anvils, a commensurate plurality of elongated tubes, a junction of said tubes opposite their respective open ends, said junction forming a fluid communication among said tubes, said frangible disc being located above said junction whereby, when said gaseous pressure exceeds the strength of said frangible disc, the disc ruptures to allow the propelling force to propel said anvils out to strike said object in said embrittled area.

109. The fragmentation tool of claim 107 including, support means secured to said tool for supporting said tool at a level below the surface of the sea.

a plurality of anvils, a commensurate plurality of elongated tubes, a junction of said tubes opposite their respective open ends, said junction forming a fluid communication among said tubes, said frangible disc being located above said junction whereby, when said gaseous pressure exceeds the strength of said frangible disc, the disc ruptures to allow the propelling force to propel said anvils out to strike said object in said embrittled area.

110. The fragmentation tool of claim 107 including, a plurality of anvils, a commensurate plurality of elongated tubes, a junction of said tubes opposite their respective open ends, said junction forming a fluid communication among said tubes, said frangible disc being located above said junction whereby, when said gaseous pressure exceeds the strength of said frangible disc, the disc ruptures to allow the propelling force to propel said anvils out to strike said object in said embrittled area, support means secured to said tool for supporting said tool at a level below the surface of the sea, at least one sealing means between each said tube and each said anvil to control any leakage of the propelling force past said anvil while remaining in contact with said direction controlling means.

* * * * *